US008104618B2

(12) United States Patent
Sadler et al.

(10) Patent No.: US 8,104,618 B2
(45) Date of Patent: Jan. 31, 2012

(54) PRIMARY PACKAGING AND DISPLAY THEREFOR

(75) Inventors: Neil A. Sadler, Weehawkin, NJ (US); Richard K. Tanaka, Astoria, NY (US)

(73) Assignee: McNeil-PPC, Inc., Skillman, NJ (US)

( * ) Notice: Subject to any disclaimer, the term of this patent is extended or adjusted under 35 U.S.C. 154(b) by 0 days.

(21) Appl. No.: 12/840,837

(22) Filed: Jul. 21, 2010

(65) Prior Publication Data

US 2010/0294691 A1 Nov. 25, 2010

Related U.S. Application Data

(63) Continuation-in-part of application No. 29/306,214, filed on Apr. 4, 2008, now Pat. No. Des. 643,295.

(60) Provisional application No. 61/230,908, filed on Aug. 3, 2009.

(51) Int. Cl.

| | |
|---|---|
| ***B65D 85/00*** | (2006.01) |
| ***B65D 85/62*** | (2006.01) |
| ***B65D 21/02*** | (2006.01) |
| ***B65D 83/04*** | (2006.01) |

(52) U.S. Cl. ..... 206/459.5; 206/45.29; 206/499; 206/509; 206/534; 206/540

(58) Field of Classification Search ..... 206/45.28–45.3, 206/459.5, 499, 534, 540, 767–768
See application file for complete search history.

(56) References Cited

U.S. PATENT DOCUMENTS

| | | | | |
|---|---|---|---|---|
| 1,949,376 | A * | 2/1934 | Mansfield et al. | 206/767 |
| 2,022,721 | A * | 12/1935 | Hompe | 206/45.29 |
| 2,168,240 | A * | 8/1939 | Roberts | 206/45.29 |
| 2,276,890 | A * | 3/1942 | Steinbiss | 206/459.5 |
| 3,200,960 | A * | 8/1965 | Banse | 206/459.5 |
| 3,300,055 | A * | 1/1967 | Rohr | 206/564 |
| 3,323,668 | A | 6/1967 | Hills | |
| 3,889,834 | A | 6/1975 | Harris, Jr. | |
| 4,308,955 | A | 1/1982 | Schieser et al. | |
| 4,513,865 | A | 4/1985 | Melzi et al. | |

(Continued)

FOREIGN PATENT DOCUMENTS

| | | |
|---|---|---|
| DE | 3642166 | 2/1988 |

(Continued)

*Primary Examiner* — Bryon Gehman
(74) *Attorney, Agent, or Firm* — Karen G. Horowitz

(57) ABSTRACT

Primary packages configured for display and sale without secondary packaging are stacked horizontally in a product display tray. The consumer-facing surface of the back panel of the product display tray may contain graphics including product information provided on the primary package's principal display panel (which is typically faced towards consumers). Thus, consumers may readily view the product information provided on the principal display panel as primary packages are removed from the product display tray and principal display panels of remaining primary packages are hidden from view by one or more walls of the product display tray. The individual primary packages may be contoured specifically to inhibit lateral relative shifting while in a horizontally stacked configuration. The individual primary packages may shaped to facilitate grasping by having a first surface contoured for grasping in the user's palm, a second surface opposite the first surface with molded branding information for engagement by a portion of the user's fingers. Molded branding information may be positioned on a surface of the primary package that faces upwardly when the primary packages are positioned in the product display tray.

14 Claims, 7 Drawing Sheets

U.S. PATENT DOCUMENTS

| | | | | |
|---|---|---|---|---|
| D304,014 | S | 10/1989 | O'Connell | |
| 4,892,207 | A | 1/1990 | Cullis | |
| 4,895,257 | A * | 1/1990 | Winslow | 206/534 |
| 5,002,199 | A | 3/1991 | Frahm | |
| 5,133,469 | A | 7/1992 | Mehta et al. | |
| 5,299,689 | A | 4/1994 | Ledewitz | |
| 5,803,289 | A | 9/1998 | Brady | |
| 6,386,367 | B1 * | 5/2002 | Bayliss, IV | 206/534 |
| 6,464,506 | B1 * | 10/2002 | Welles | 206/534 |
| 7,000,794 | B2 | 2/2006 | Soehnlen et al. | |
| 7,036,693 | B2 | 5/2006 | Walsh et al. | |
| 2007/0023314 | A1 | 2/2007 | Hsu | |
| 2007/0102320 | A1 | 5/2007 | Van Der Krogt et al. | |
| 2008/0257777 | A1 * | 10/2008 | Miceli et al. | 206/534 |
| 2009/0140513 | A1 * | 6/2009 | Priebe et al. | 206/459.5 |

FOREIGN PATENT DOCUMENTS

| | | |
|---|---|---|
| DE | 202005008852 | 11/2006 |
| EP | 322259 | 8/1988 |
| FR | 2395905 | 1/1979 |

* cited by examiner

PRIMARY PACKAGING AND DISPLAY THEREFOR

CROSS-REFERENCE TO RELATED APPLICATION

The present application claims the benefit of the earlier filing date of U.S. provisional patent application 61/230,908, filed Aug. 3, 2009, and is a continuation-in-part of and claims the benefit of the earlier filing date of U.S. design patent application No. 29/306,214, filed Apr. 4, 2008, now U.S. Pat. No. D,643,295 which applications are hereby incorporated by reference herein in their entireties.

FIELD OF THE INVENTION

The present invention relates to reduction of packaging materials for containers. More particularly, the present invention relates to improvements to primary packagings so that secondary packagings may be eliminated. The present invention also relates to manners of displaying primary packagings.

BACKGROUND OF THE INVENTION

Various approaches to creating environmentally-friendly packaging and to reducing packaging costs are known. One approach is to reduce the materials used to form the package. For instance, consumer articles typically are packaged in a primary package (directly containing the article, such as a bottle which contains a fluid or solid form), which primary package is then placed in another, secondary package (such as a paperboard or cardboard box). Typical primary packaging for consumer articles have curved or rounded side walls, whereas typical corresponding secondary packaging has flat side walls. Thus, the outer surface area of the secondary packaging typically is greater than that of the primary packaging, and greater than necessary simply to enclose the primary packaging. A more environmentally-friendly approach to packaging reduces or even eliminates the secondary packaging. However, secondary packaging is often beneficial for providing product information about the article contained within the primary packaging, as the primary packaging often does not provide enough outward surface area to display all the information about the article typically desired by consumers, or required by federal agencies. For instance, various over-the-counter (non-prescription, or "OTC" for short) consumer articles, such as OTC drug products, are regulated by the Food and Drug Administration (FDA), which, as an agency, requires specific product information, such as the statement of identity (established name and general pharmacological class), quantity and dosage form, and Drug Facts, to be displayed on the packaging. Drug facts may include, but are not limited to, information on the active ingredient, active ingredient chemical name, active ingredient dosage, uses, warnings, directions, and inactive ingredients. Drug labels are also required to have lot number and expiration dating, and a company contact, which includes manufacturer or distributor information.

Upon eliminating secondary packaging, and packing or stacking together multiple primary packages with typically convexly-curved side walls (typical primary packages for OTC drug products have substantially circular cross-sections), it becomes evident that an excess amount of empty space is generated between the surfaces of the convexly-curved walls of the primary packages that cannot be stacked against one another. One solution has been to use primary packaging with one or more substantially flat side walls, such as a primary package with a quadrilateral cross-section. Such primary packaging, however, may not be as comfortable to hold in the user's hand, particular if the primary package is sized to fit in at least a portion of the palm of the user's hand.

Various primary packages with quadrilateral cross-sections have been designed to be stacked horizontally, i.e., with their longitudinal axes (along which the opening to the primary package and the bottom closed end of the primary package lie) substantially horizontal. Such stackable primary packages are shaped to be laid on their substantially flat side walls, or on side walls that have a flat section for stabilizing the primary package when laid horizontally. Although interlocking or intermeshing features may be provided to inhibit relative lateral shifting of the stacked primary packages, there typically is a need for further lateral stabilization of such stacked primary packages.

SUMMARY OF THE INVENTION

In accordance with the principles of the present invention, a primary package is formed with at least one stable surface, such as a substantially flat side wall, to permit the primary package to be rested on a surface in a substantially horizontal orientation (with the longitudinal axis, along which the open end is formed, in a substantially horizontal orientation) in a substantially stable manner (such that a lateral impact to the primary package results in little or no pitching or rolling of the primary package about its longitudinal axis). Until the present invention, horizontally stacked primary packages had not been used for OTC drug products. A primary package formed in accordance with the principles of the present invention provides sufficient surface area for the information required by the FDA to be displayed in a manner that is readily visible to consumers at the point of purchase, while also providing product-identifying information.

In accordance with another aspect of the present invention, a primary package having a substantially quadrilateral cross-section is formed to facilitate grasping thereof in the hand of a consumer. In particular, a debossed, impressed, engraved, or embossed shape may be formed along at least a portion of one of the side walls of the primary package. Such shape is preferably positioned for engagement by a portion of the user's hand, such as the user's fingers, such as to reduce slippage of the primary package when grasped by the user. At least one pair of the opposing walls of the quadrilateral-cross-section primary package may optionally be curved, such as one of the pair being concave and the other of the pair being convex. A user may find grasping of such primary package to be more comfortable with the concave wall in the user's palm or against the user's thumb or thumb base, and the convex wall grasped by the user's fingertips, or, alternatively, with the convex wall in the user's palm or against the user's thumb or thumb base, and the concave wall grasped by the user's fingertips. Positioning of the debossed, impressed, engraved, or embossed shape along at least a portion of the convex wall such that a portion of the user's hand (e.g., palm, thumb, thumb base, fingers, fingertips, or any portion thereof) may engage such shape further facilitates grasping of the primary package, such as by reducing lateral shifting of the primary package in the user's hand. The shape may be branding information, such as the brand name.

In accordance with another aspect of the present invention, a primary package may be formed with opposing surfaces configured to permit horizontal stacking of such primary packages. The opposing surfaces may be provided in opposing curved walls, such as a concave wall formed opposite a convex wall. In order to inhibit lateral shifting of the stacked primary packages, a recess may be formed in the concave wall, and a raised section may be formed in the convex wall to engage the recess of a similarly-formed primary package. Such recess and raised section inhibit lateral shifting of stacked primary packages. The debossed, impressed, engraved, or embossed shape described above may be formed in such raised section. If desired, the raised section may be formed to indicate the content of the primary package, such as by being formed in a shape corresponding to the content of the primary package.

In accordance with yet another aspect of the present invention, a plurality of horizontally stacked primary packages may be displayed in a display tray configured to impart lateral stability to the stacked primary packages. Because a display tray typically has vertically extending side walls, if the primary packages are horizontally stacked, the display tray side walls (particularly the front side wall facing consumers) may block at least some, if not all, of the primary packages in the bottom-most layer of stacked primary packages (i.e., the horizontally positioned primary packages lying directly on the interior bottom surface of the display tray). In accordance with yet a further aspect of the present invention, graphics may be provided along at least a portion of the consumer-facing surfaces of the display tray. Thus, as primary packages are removed, a consumer still can readily identify the product contained in the primary package even if there is little or no product on the upwardly-facing surface of the horizontally positioned primary packages in the display tray.

In one embodiment, primary packages formed in accordance with one or more principles of the present invention are useful for containing a plurality of oral solid dosage forms or OTC drug products such as tablets or caplets. In this embodiment the packaging allows for individual dosages to be segmented upon shaking of the bottle while the package is grasped.

These and other features and advantages of the present invention will be readily apparent from the following detailed description of the invention, the scope of the invention being set out in the appended claims.

BRIEF DESCRIPTION OF THE DRAWINGS

The detailed description will be better understood in conjunction with the accompanying drawings, wherein like reference characters represent like elements, as follows.

DETAILED DESCRIPTION OF THE INVENTION

Figure 1:
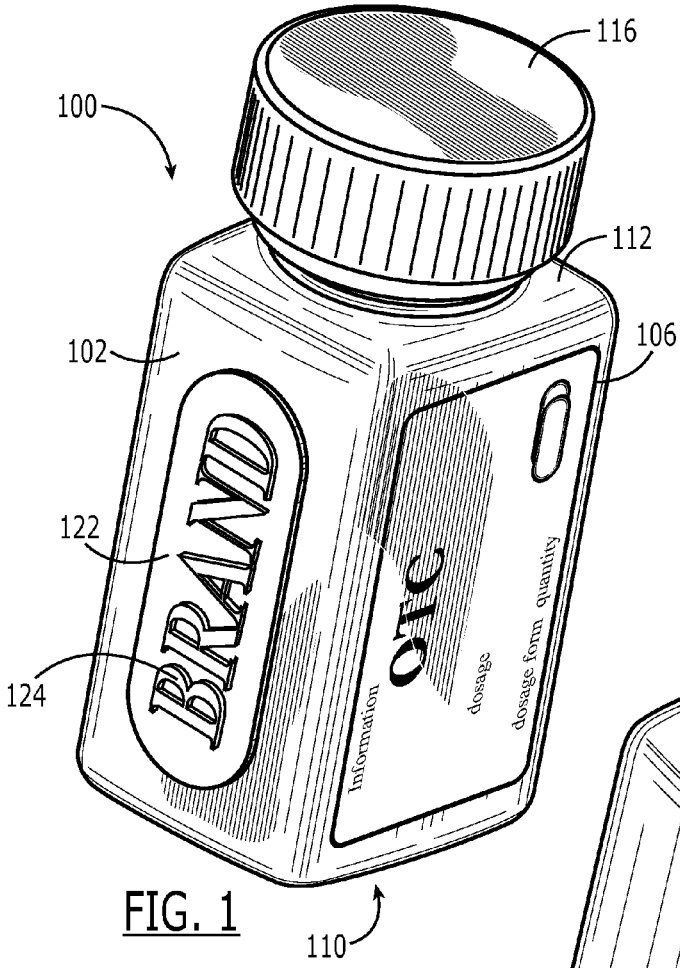
FIG. 1 is a top side, front side, top end perspective view of an exemplary stackable primary package formed in accordance with principles of the present invention.
Figure 2:
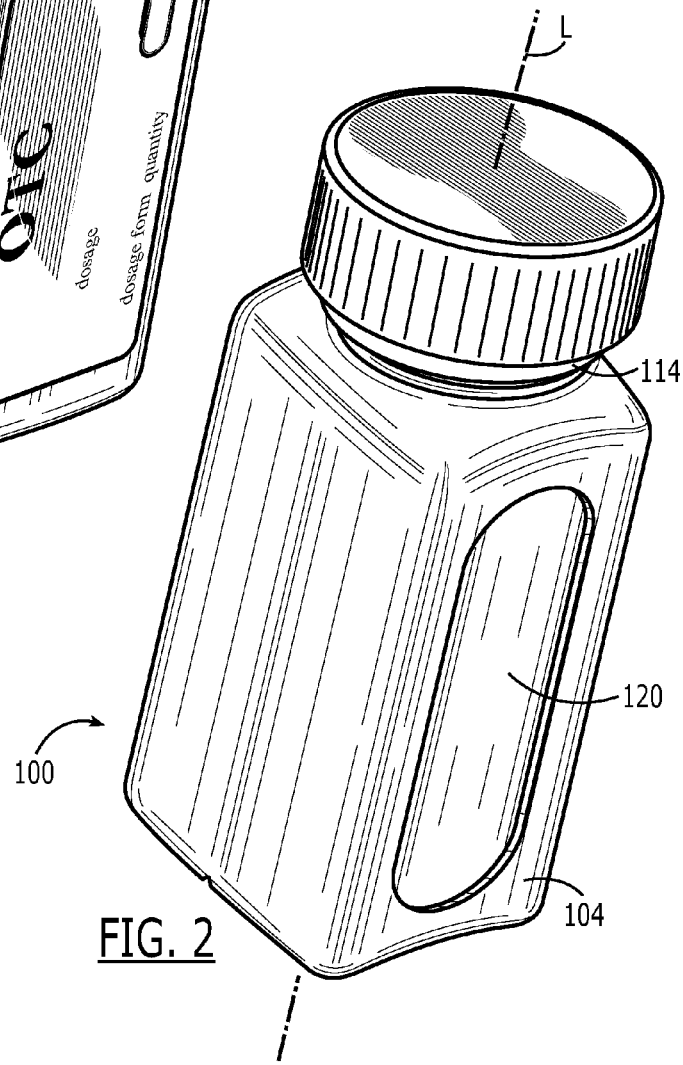
FIG. 2 is a back side, bottom side, top end perspective view of the exemplary primary package of FIG. 1.
Figure 3:
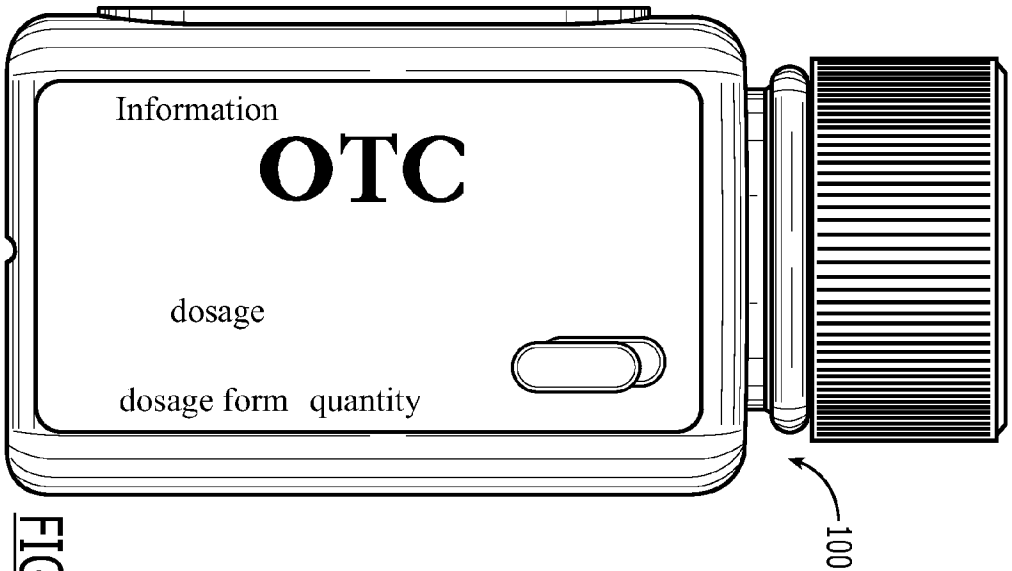
FIG. 3 is a front elevational view of the exemplary primary package of FIG. 1.
Figure 4:
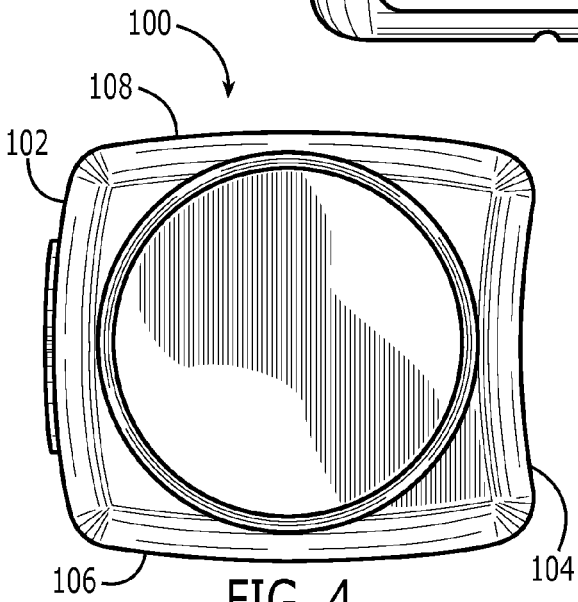
FIG. 4 is a top end view of the exemplary primary package of FIG. 1.
Figure 5:
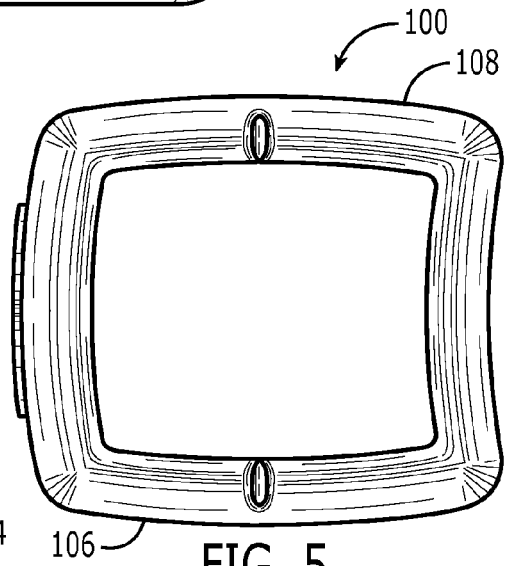
FIG. 5 is a bottom end view of the exemplary primary package of FIG. 1.

An exemplary primary package 100 formed in accordance with principles of the present invention is illustrated in FIGS. 1-8. As may be appreciated, particularly with reference to the top and bottom end views of FIGS. 4 and 5, respectively, primary package 100 has an essentially quadrilateral cross-sectional shape. In particular, primary package 100 has opposing top and bottom side walls 102, 104, respectively, and opposing front and back side walls 106, 108, respectively. Primary package 100 may be oriented vertically, with longitudinal axis L substantially vertical, to rest on bottom end 110. Of course, bottom end 110 may be curved and thus not necessarily configured to permit primary package 100 to rest thereon. Top end 112 may have an opening formed by a neck finish 114 through which products contained within primary package 100 may be accessed. Any desired type of closure, such as cap 116, may be provided to close open top end 112 to retain products within primary package 100.

Figure 6:
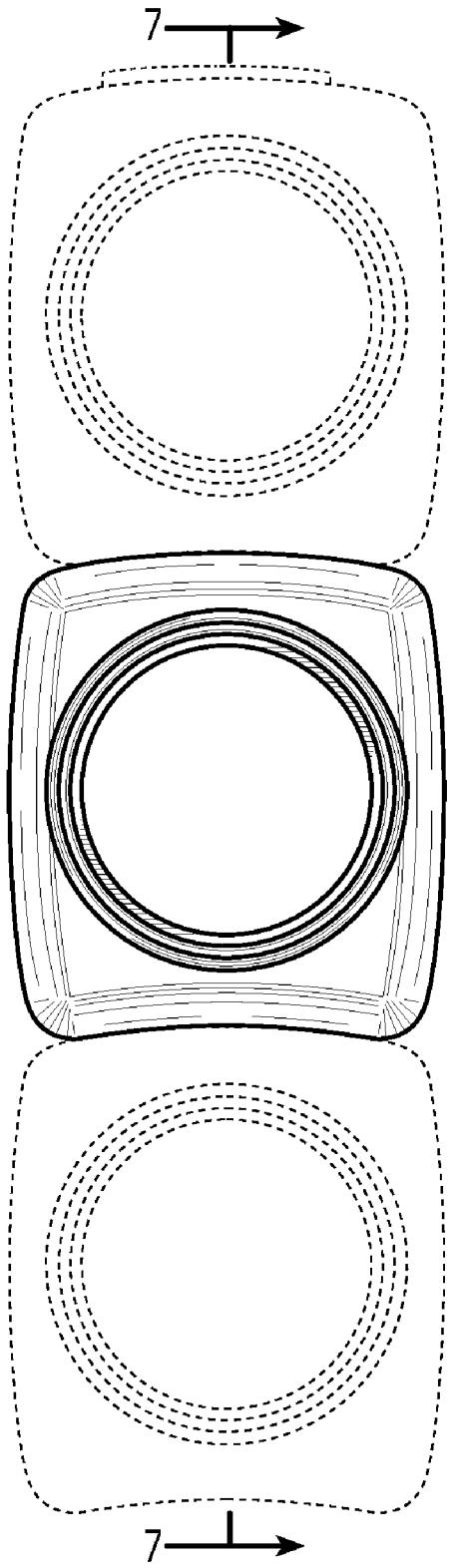
FIG. 6 is a top end view of the exemplary primary package of FIG. 1 stacked and interlocked with substantially identical primary packages.
Figure 7:
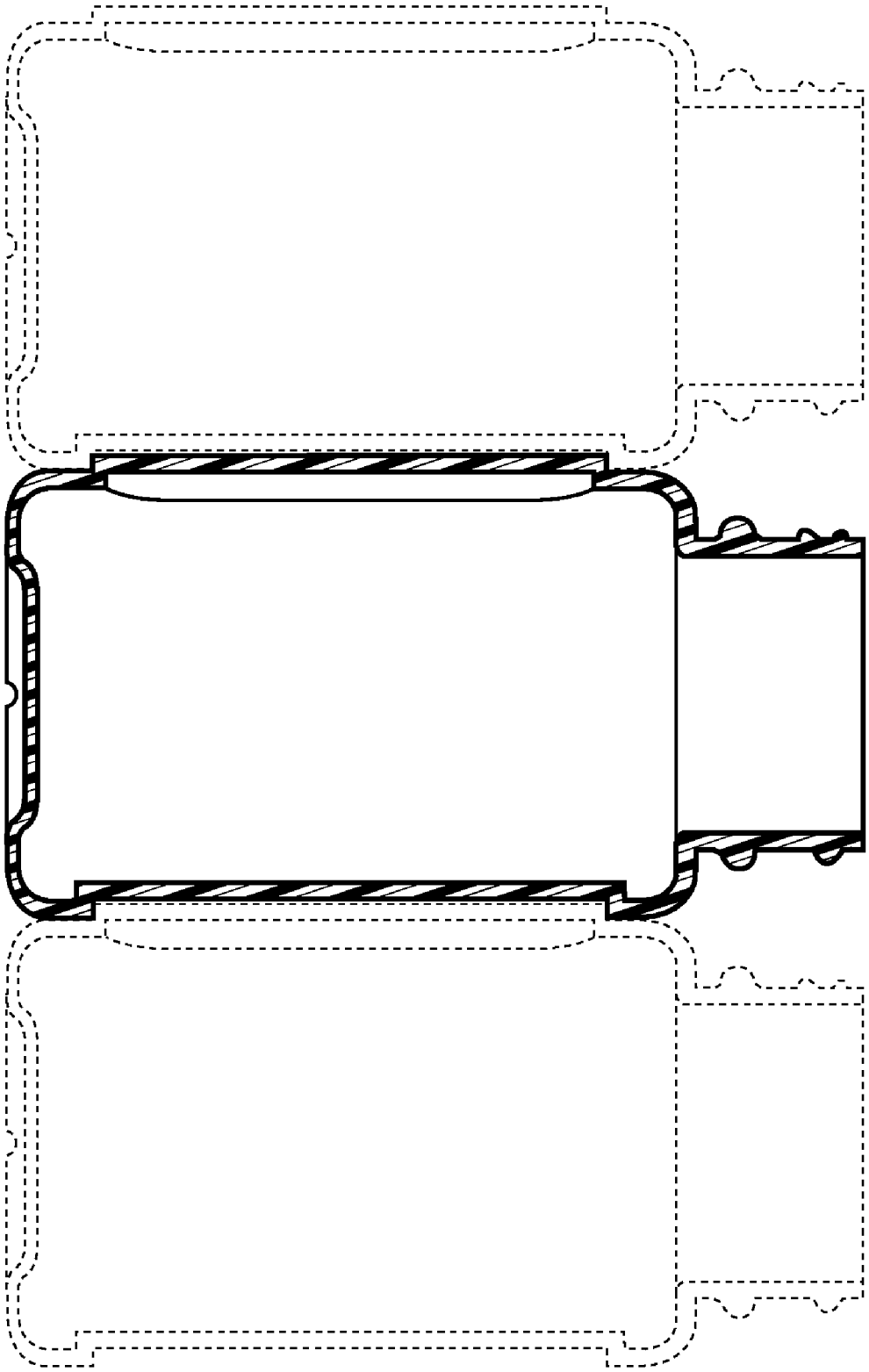
FIG. 7 is a cross-sectional view along line 7-7 of FIG. 6.

In accordance with one aspect of the present invention, primary package 100 may be rested horizontally on a surface (with longitudinal axis L oriented substantially horizontally). Preferably at least one of side walls 102, 104, 106, 108 of package 100 is contoured (such as provided with a flat) to permit primary package 100 to rest in a stable manner in a horizontal orientation. Further in accordance with an aspect of the present invention, a plurality of primary packages 100 may be stacked horizontally on top of one another, as illustrated in FIG. 6. If desired, at least one pair of opposing walls (either top side wall 102 and bottom side wall 104, or front side wall 106 and back side wall 108) are curved or otherwise contoured or configured to engage one another in a manner to reduce lateral movement between stacked primary packages 100. In the exemplary embodiment of FIGS. 1-8, top side wall 102 and bottom side wall 104 are curved in complementary manners to inhibit lateral movement between stacked primary packages 100 with top side wall 102 of one primary package 100 engaged with bottom side wall 104 of another primary package 100. More particularly, in the exemplary embodiment of FIGS. 1-8, top side wall 102 includes a convexly curved surface and bottom side wall 104 includes concavely curved surface with a radius of curvature substantially corresponding to the radius of curvature of the convexly-curved surface of top side wall 102. However, other contours are within the scope of the present invention, and such contours may be applied, instead or in addition, to front side wall 106 and back side wall 108.

Alternatively, or additionally, a recess 120 may be provided in one of side walls 102, 104, 106, 108, and a corresponding raised section 122, sized and shaped to fit within recess 120, may be provided on the opposite side wall. Such recess and raised section are illustrated as being provided, respectively, in a concavely curved surface and a convexly curved surface. However, the surfaces in which recess 120 and raised section 122 are provided may have any other contour, such as flat or the same (e.g., both convex), so long as raised section 122 can be engaged within recess 120. In the exemplary embodiment of FIGS. 1-8, recess 120 is formed within bottom side wall 104 and corresponding raised section 122 is formed in top side wall 102. However, the reverse arrangement (with recess 120 in top side wall 102 and raised section 122 in bottom side wall 104) may be provided, or recess 120 may be formed in one of front side wall 106 and back side wall 108 with corresponding raised section 122 being formed in the other of front side wall 106 and back side wall 108. As such, primary packages 100 may intermesh or interlock with one another.

Recess 120 and raised section 122 may be formed in any desired shape. In the exemplary embodiment, recess 120 and raised section 122 are formed in substantially the same shape and match each other. However, recess 120 and raised section 122 need not having matching shapes so long as they engage each other to provide the desired inhibition of lateral movement of the primary packages 100 that are engaged with one another upon engaging a recess 120 of one with a raised section 122 of another. If desired, one or both of recess 120 and raised section 122 can be in the shape of the product to be contained within primary package 100. In accordance with one aspect of the present invention, primary package 100 may contain a solid oral dosage form of an OTC drug product (such as a tablet, pill, capsule, caplet, etc.), and at least one of recess 120 and raised section 122 may be shaped to match the shape of the solid oral dosage form. In the exemplary embodiment of FIGS. 1-8, both recess 120 and raised section 122 have a capsular shape (and primary package 100 thus may contain capsules or caplets as indicated by such capsular shape).

It will be appreciated that the walls in which recess 120 and corresponding raised section 122 are formed need not be curved (as are top side wall 102 and bottom side wall 104), since interlocking or intermeshing of such features achieve the desired inhibition of lateral movement otherwise provided by mating contours. It will further be appreciated that more than one interlocking features may be provided, in the form of a recess and corresponding raised section or in any other form that would inhibit lateral movement of horizontally stacked primary packages.

In accordance with another related yet independent aspect of the present invention, forms such as branding information 124 (such as, without limitation, logos, brand names, selected letters from the brand name, etc., and referenced hereinafter as "branding information" for the sake of simplicity without intent to limit) may be formed into at least one of side walls 102, 104, 106, 108 of primary package 100. Such forming may be achieved in any desired manner which preferably alters the surface contour of the side wall in which the branding information is formed, such as by debossing, engraving, impressing, or embossing. For the sake of convenience, and without intent to limit the present invention to any particular manner of forming such forms as branding information 124, reference will be made to "molding" or "molded" with the understanding that a molding process is an optional but not necessary manner of achieving or forming the desired feature. The formation of branding information 124 in at least one of side walls 102, 104, 106, 108 permits product identification even if labeling is not provided on such wall. For instance, as will be discussed in greater detail below, if primary packages 100 are stacked within a box or tray, and labeling is provided on only the vertically oriented side walls, then such labeling may not be readily seen when looking down on one of primary packages 100. Preferably, branding information 124 is provided on the upwardly facing side wall of primary package 100 (top side wall 102) to be readily visible when viewing a stack of primary packages 100 from above.

It will be appreciated that forms other than those specifically associated with branding may be formed in one or more surfaces of package 100. As such, although reference is made to branding information 124, such feature is not limited to branding, and may be in any other desired shape or form. In accordance with another aspect of the present invention, one or more forms may be formed into package 100 to facilitate grasping of primary package 100 in a user's hand. Although such forms as branding information 124 may be provided in a side wall that is not curved or as curved as top side wall 102 or bottom side wall 104 of exemplary primary package 100 of FIGS. 1-8, formation of forms such as branding information 124 in a curved side wall provides an additional benefit. In particular, exemplary primary package 100 may be sized to be held in a user's hand, with a convexly-contoured top side wall 102 and a concavely-contoured bottom side wall 104. Concavely contoured bottom side wall 104 may be comfortably held against the palm or thumb or thumb base of the user's hand so that the user's fingers (other than the thumb if the thumb is held against concavely contoured bottom side wall 104) grasp convexly-contoured top side wall 102. Alternatively, convexly contoured top side wall 102 may be comfortably held against the palm or thumb base of the user's hand so that the user's fingers (other than the thumb if the thumb is held against convexly contoured top side wall 102) grasp concavely-contoured bottom side wall 104. Provision of contoured forms such as branding information 124 in convexly-contoured top side wall 102 permits the user to engage a portion of the user's hand (e.g., palm, thumb, thumb base, fingertips) with branding information 124 to enhance gripping, the contouring of branding information 124 forming an uneven surface inhibiting lateral movement thereof with respect to the user's grasping hand. Of course, it will be appreciated that a contour other than a concave contour may be provided to enhance grasping of such surface in the user's hand, and contoured forms such as branding information 124 may be formed in a surface contoured other than in a convex contour, while still enhancing grasping of primary package 100.

As noted above, a primary package 100 formed in accordance with principles of the present invention may be used for packaging solid oral dosage forms of an OTC drug product. Typically, federal laws have strict requirements with respect to labeling and provision of information about solid oral dosage forms of OTC drug products, such as set forth in Part 201 of Title 21 of the Code of Federal Regulations. Accordingly, until now, although prescription medicines and dietary supplements have been sold in primary packages without secondary packaging, OTC drug products generally have not been sold in primary packages without secondary packaging. Moreover, although stackable primary packages or containers have been known in the prior art for at least forty years prior to the present invention, such primary packages have not been described as being particularly suitable for packaging OTC drug products for consumer sale.

Figure 8:
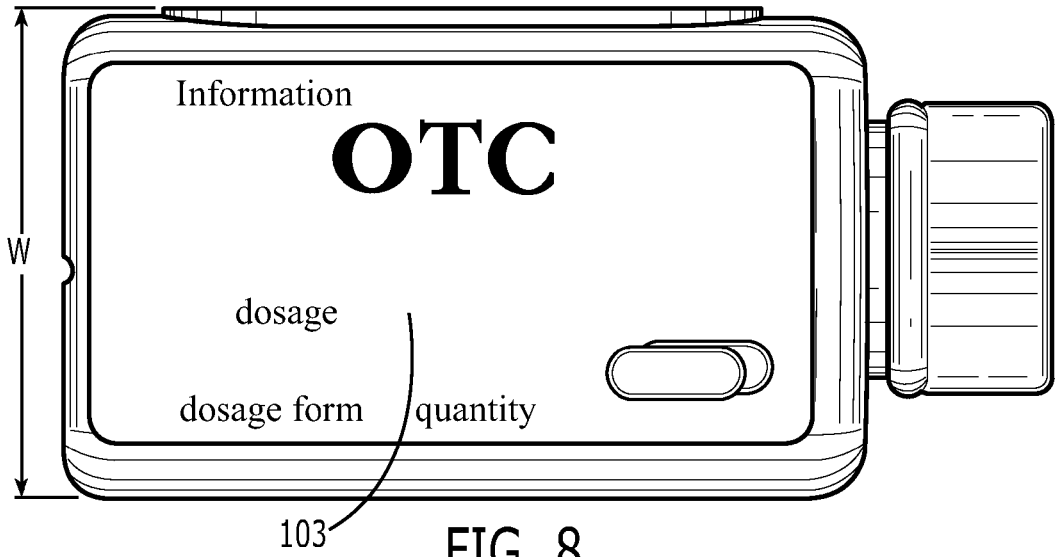
FIG. 8 is a front side elevational view of an exemplary primary package formed in accordance with principles of the present invention with a product-identifying label.

In accordance with the principles of the present invention, previous hurdles, such as those presented by strict federal labeling requirements, have been overcome by forming a stackable primary package with side walls having sufficient surface area to fit the federally-required product information. In particular, primary package 100 may be formed in accordance with the present invention for stacking on shorter top side wall 102 and bottom side wall 104, allowing longer front side wall 106 and back side wall 108 to have surfaces that readily accommodate labeling (i.e., not having complex contours which complicate application of labels thereto) and which are forwardly-facing (towards consumers) when the primary packages are in a stacked configuration. At least one label provides information about the content of primary package 100. As illustrated in FIG. 8, a principal display panel 103 ("PDP") is provided on front side wall 106 of primary package 100. The text of PDP's (as set forth in 21 C.F.R. §201.60)

must be oriented for reading, at the point of sale, of at least a statement of identity of the contents, and the net quantity (which text must be reasonably parallel to the base on which the product rests). Thus, if primary package 100 is to be horizontally stacked, then at least identity and quantity information must be written along longitudinal axis L of primary package 100 so as to be readily legible when primary package 100 is laid horizontally (with longitudinal axis L in a horizontal orientation). Thus, although PDP 103 may be applied to primary package 100 in any desired manner (e.g., directly printed on front side wall 106, or in the form of a label applied to front side wall 106), content-information is oriented along longitudinal axis L for ready reading when primary package 100 is laid horizontal on a surface. The additional, more detailed federally-required information (such as what is specifically known as the "Drug Facts" in 21 C.F.R. §201.66(c)) may be oriented in the same direction as front label information or in an orientation transverse to longitudinal axis L (if the bottle is to be placed on its bottom end by the consumer). The federally required Drug Facts may be provided in booklet form affixed to the wall opposite the wall bearing PDP 103 (in the embodiment of FIG. 8, back side wall 108) to be opened by the consumer. Thus, the text of at least the interior of the booklet provided on back side wall 108 (not shown) is oriented horizontally for reading when package 100 is in a vertical upright position (with longitudinal axis L in a vertical orientation) as would be typical when stored in a consumer's home (such as on a counter or medicine cabinet shelf).

Figure 9:
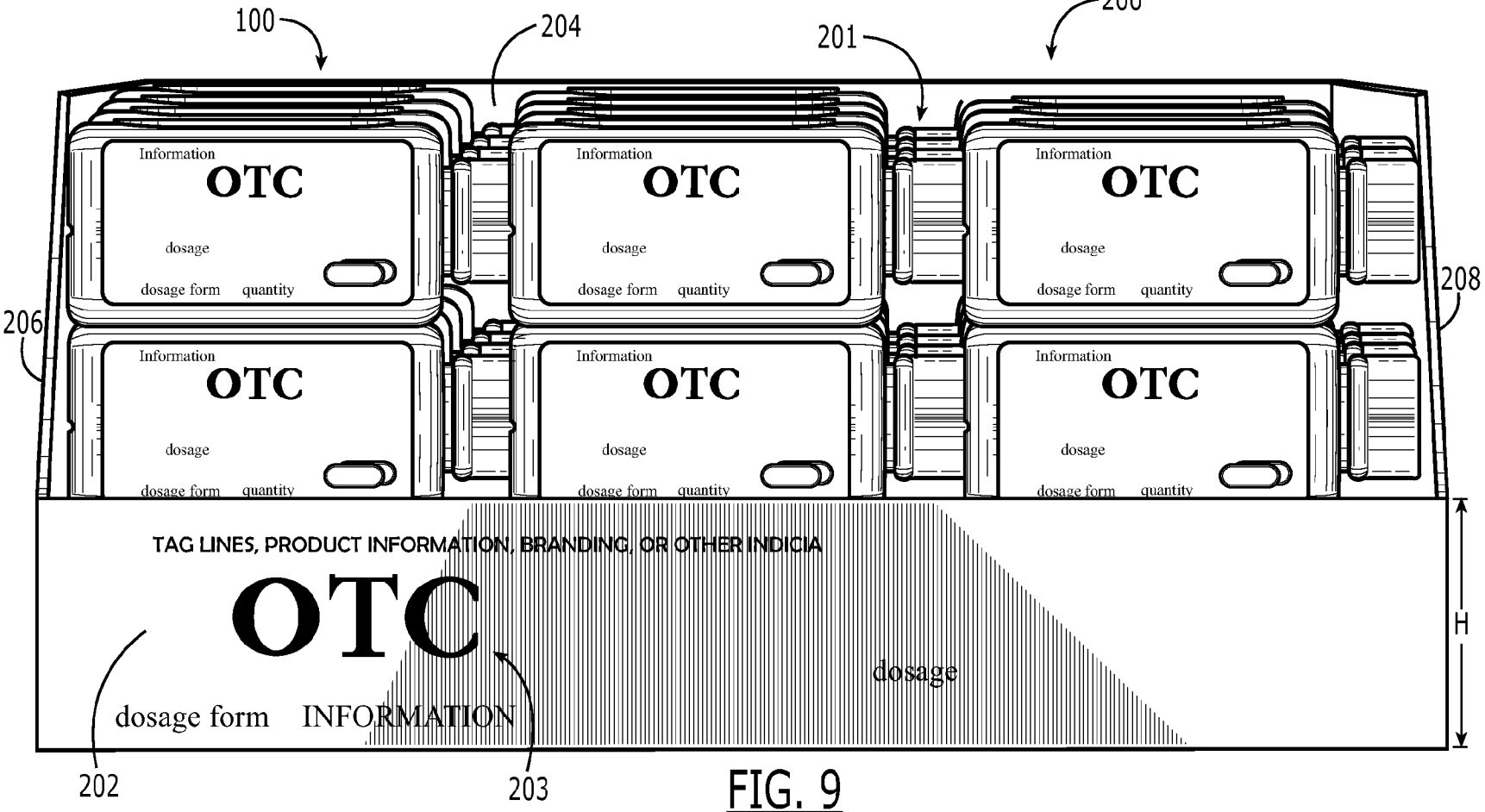
FIG. 9 is a perspective view of an exemplary display tray formed in accordance with principles of the present invention and filled with exemplary primary packages formed in accordance with principles of the present invention.
Figure 10:
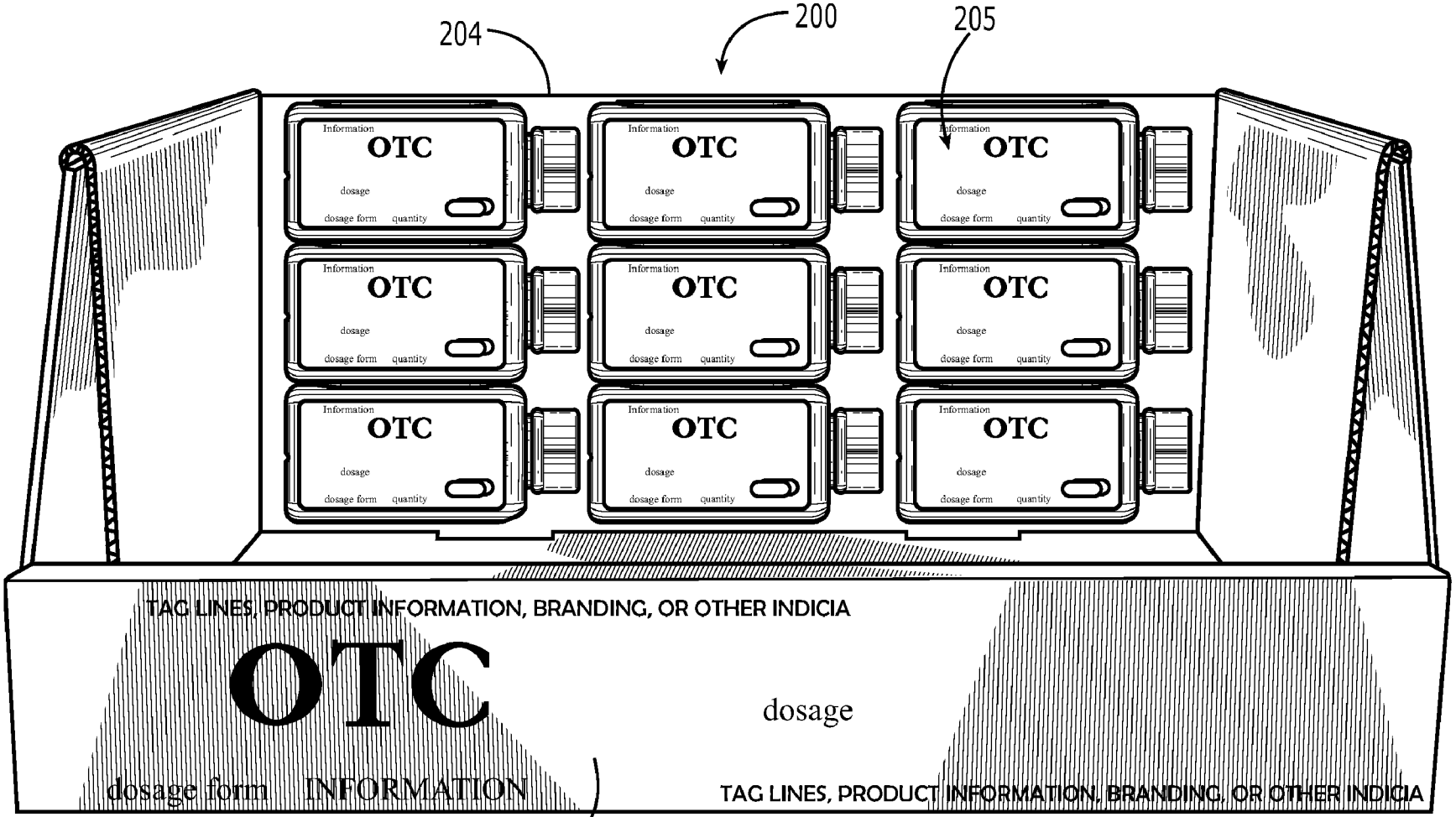
FIG. 10 is a perspective view of the exemplary display tray of FIG. 9, but without primary packages therein.

As described above, primary package 100 is preferably particularly formed to inhibit lateral relative movement of stacked primary packages 100 such as by engaging correspondingly contoured surfaces with each other, and/or by more securely interlocking or intermeshing the contacting surfaces, such as by engaging a raised section into a recess. In accordance with a separate aspect of the present invention, stackable primary packages, such as (but not necessarily) exemplary primary package 100, may be stacked horizontally within a display tray having one or more vertical walls providing laterally stability to the stacked primary packages. An exemplary product display tray 200 configured to contain a plurality of primary packages laid horizontally therein and stacked on one another is illustrated in FIGS. 9 and 10. Product display tray 200 has a product display area 201 formed within one or more vertically extending side walls 202, 204, 206, 208 which preferably are configured to provide lateral support (when needed) to primary packages 100 stacked within product display area 201. In particular, front side wall 202 and back side wall 204 of product display tray 200, if provided, can inhibit forward and rearward shifting of primary packages 100, particularly upon placement of product display tray 200 on a retail shelf or other display surface for consumer display. Right side wall 206 and/or left side wall 206 of product display tray 200, if provided, are helpful for inhibiting lateral shifting of primary packages 100, such as when consumers reach into product display area 201 to remove a primary package 100.

Front side wall 202 of product display tray 200 is also particularly useful for providing "billboard" surface area for product information, branding (e.g., brand name, logos, etc.), tag lines, or other indicia 203. However, as may be appreciated upon comparison of FIGS. 9 and 10, height H of front side wall 202 may cover at least a portion of PDP 103 of primary package 100, thereby impeding consumers' ability to read PDP 103. Without being able to read PDP 103 readily, and particularly if no label is provided on top side wall 102, consumers are not readily able to identify the contents of primary package 100 and thus may be inhibited from purchasing the product packaged in primary package 100. Moreover, height H of front side wall 202 of product display tray 200 may even be at least as high as or even higher than width W primary package 100 (see FIG. 8), which is essentially the height (in a vertical direction) of front side wall 106 of primary package 100 when primary package 100 is laid horizontally. A front side wall 202 that is at least as high as width W of primary packages 100 within product display area 201 of product display tray 200 may block the lower-most layer of primary packages 100 from view. Such blocking of primary packages 100 is particularly detrimental when only the bottom-most primary packages 100 (i.e., those resting directly on bottom wall 210 of product display tray 200) are left within product display area 201. Even if front side wall 106 of primary package 100 is visible and bears branding information 124, such information may not be sufficient to catch the eye of the average consumer when making a quick purchase. Consumers therefore may overlook products in product display 100 when only the bottom-most layer of primary packages 100 is left.

In accordance with another aspect of the present invention, the forwardly facing surface of back side wall 204 of product display tray 200 (i.e., the surface facing toward front side wall 202, and thus in the direction readily visible to consumers) is provided with graphics 205 that communicate or signal to the consumer the content of product display tray 200. Graphics 205 are illustrated in FIG. 10 as mimicking (in the form of a graphic reproduction of) a stack of primary packages 100 in the orientation in which primary packages 100 would be provided within product display area 201 of product display tray 200 (i.e., forwardly-facing, with PDP 103 facing forwardly in the direction of front side wall 202 for ready viewing by consumers). Information provided by graphics 205 preferably includes at least some, if not all, information provided on PDP 103. In the exemplary embodiment of FIG. 10, graphics 205 is a 1:1 scaled replica of primary packages 100 stacked to fill product display area 201 of product display tray 200. However, it will be appreciated that other forms of graphics 205 providing sufficient information to identify the product contained within primary package 100 and/or to communicate to consumers the content of product display tray 200 are within the scope of the present invention. Typically provision of at least the brand name, the statement of identity (consisting of the established name and general pharmacological class), and the dosage form permits sufficient information to identify the product. Such product-identifying information may be provided in any desired format that is visible to consumers to permit consumers to identify the product within product display tray 200, such information complying, as required, with any applicable rules under Title 21 of the Code of Federal Regulations. Also, graphics may be provided on the product-facing surfaces of one or both of right side wall 206 and left side wall 208 of product display tray 200.

Although exemplary primary packages 100 and exemplary product display tray 200 need not be used in conjunction with one another, and each have separate and independent inventive features, display of primary packages 100 formed in accordance with the principles of the present invention within product display tray 200 formed in accordance with the principles of the present invention results in unique benefits. In particular, display of primary packages 100 formed in accordance with above-described principles of the present invention within a product display tray 200 formed in accordance with above-described principles of the present invention permits substantially continuous consumer identification of the product contained within primary packages 100. More particularly, a primary package 100 formed in accordance with above-described inventive principles may have not only a PDP 103 visible from a forwardly-facing surface when primary package 100 is laid horizontally, but also branding information 124 visible from an upwardly-facing surface when primary package 100 is laid horizontally. In addition, when displayed in a product display tray 200 formed in accordance with above-described inventive principles, even if PDP 103 is blocked by front side wall 202 of product display tray 200, the information provided on PDP 103 is visible on the forwardly-facing surface of back side wall 204 as individual primary packages 100 are removed from product display area 201, and thus readily visible to consumers at all times.

While the foregoing description and drawings represent exemplary embodiments of the present invention, it will be understood that various additions, modifications, and substitutions may be made therein without departing from the spirit and scope of the present invention. In particular, it will be clear to those skilled in the art that the present invention may be embodied in other specific forms, structures, arrangements, proportions without departing from the spirit or essential characteristics thereof. One skilled in the art will appreciate that the invention may be used with many modifications of structure, arrangement, proportions, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being indicated by the appended claims, and not limited to the foregoing description.

What is claimed is:

1. A method of packaging and displaying products in a display tray, said method comprising:

packaging products in primary packages without secondary packaging of the primary packages, each of said primary packages having:

a front side wall, a back side wall opposite said front side wall, a top side wall extending between said front side wall and said back side wall, and a bottom side wall extending between said front side wall and said back side wall and opposite said top side wall; and a longitudinal axis extending along and between said front side wall, said back side wall, said top side wall, and said bottom side wall, and along which axis is formed an opening through which said products within said primary package are accessible;

wherein:

said bottom side wall is contoured to permit said primary package to rest in a stable manner thereon in a substantially horizontal orientation with said longitudinal axis oriented substantially horizontally; and said top side wall has a surface in which branding information is formed in a manner altering the contour of said top side wall surface;

stacking a plurality of said primary packages substantially horizontally and directly on top of one another in a product display tray; and arranging said stacked primary packages within said display tray to rest on said bottom side walls of said primary packages with said branding information on said top side walls of said primary packages facing in a substantially upward direction.

2. The method of claim 1, wherein:

a principal display panel with product-specific information is provided on said front side wall of each of said primary packages, said product-specific information being oriented to be read by a consumer when said primary packages are in the substantially horizontal orientation within said display tray;

said product display tray has a front side wall with a consumer-facing surface, a back side wall with a consumer-facing surface, and a bottom wall extending between and supporting said front side wall and said back side wall of said display tray; and stacking a plurality of said primary packages includes arranging a bottom level of a plurality of primary packages within said display tray on said bottom wall of said display tray in the horizontal orientation such that said principal display panels of each of said primary packages in said bottom level are at least partially blocked said front side wall of said display tray, said branding information facing in a substantially upward direction to be viewable by a consumer from within said display tray despite said product-specific information on said principal display panels being blocked from view.

3. A method of packaging and displaying products in a display tray, said method comprising:

packaging said products in primary packages without secondary packaging of the primary packages, each primary package having:

a front side wall, a back side wall opposite said front side wall, a top side wall extending between said front side wall and said back side wall, and a bottom side wall extending between said front side wall and said back side wall and opposite said top side wall; and a longitudinal axis extending along said front side wall, said back side wall, said top side wall, and said bottom side wall, and along which axis is formed an opening through which said products within said primary package are accessible;

wherein:

said bottom side wall is contoured to permit said primary package to rest in a stable manner thereon in a substantially horizontal orientation with said longitudinal axis oriented substantially horizontally; and a principal display panel is provided on said front side wall, said principal display panel bearing product-specific information oriented substantially parallel with said longitudinal axis for reading by a consumer when said primary package is positioned within said product display tray in a substantially horizontal orientation;

stacking a plurality of said primary packages substantially horizontally and directly on top of one another in said display tray, said display tray having at least a front side wall with a consumer-facing surface bearing product-related indicia, a back side wall with a consumer-facing surface bearing at least some of said product-specific information provided on said principal display panel of each of said primary packages, and a bottom wall extending between and supporting said front side wall and said back side wall of said display tray; and orienting said primary packages within said display tray with said principal display panels facing in the direction of said display tray front side wall;

wherein:

stacking a plurality of said primary packages includes arranging a first layer of primary packages on said bottom wall of said display tray in the horizontal orientation such that at least a portion of said principal display panel is blocked from view by said front side wall of said display tray; and a replica of said principal display panel is provided on said consumer-facing surface of said back side wall of said product display tray so that when only a first layer of primary packages remains in said display tray with said front side wall of said display tray blocking said front side walls of said primary packages in said first layer, at least some of said product-specific information provided on said principal display panel of each of said primary packages is nonetheless viewable on said consumer-facing surface of said back side wall of said display tray.

4. The method of claim 3, wherein providing a replica of said principal display panel on said consumer-facing surface of said back side wall of said product display tray further comprises providing a graphic image of said primary packages in a stacked configuration visually reproducing the image of stacked primary packages.

5. The method of claim 4, wherein said graphic image is a 1:1 scaled replica of stacked primary packages.

6. The method of claim 1, wherein:

said products comprise a plurality of articles of the same shape packaged within said primary package; and said branding information is provided on a raised section shaped to correspond substantially to said article shape.

7. The method of claim 6, wherein:

said articles comprise oral dosage forms of over-the counter drug products; and said method further comprises packaging said oral dosage forms of over-the-counter drug products directly in said primary packages.

8. A product display comprising:

a product display tray having a product display area configured for containing and displaying products therein along a consumer-facing side of said product display tray; and a plurality of primary packages displayed in said product display area;

wherein:

each of said primary packages contains at least one product displayed in said primary packages without secondary packaging of the primary packages;

each primary package has:

a front side wall;

a back side wall opposite said front side wall axis;

a top side wall extending between said front side wall and said back side wall;

a bottom side wall opposite said top side wall and extending between said front side wall and said back side wall and having at least one stable surface contoured to permit said primary package to rest thereon in a stable manner; and a longitudinal axis extending along said front side wall, said back side wall, said top side wall, and said bottom side wall, and along which is formed an opening through which axis said at least one product within said primary package is accessible; and wherein said at least one stable surface permits said primary package to rest in a stable manner thereon in a substantially horizontal orientation with said longitudinal axis oriented substantially horizontally;

said plurality of primary packages are stacked one on top of another in said product display area in substantially horizontal orientations;

branding information is formed in said top side wall of each primary package in a manner altering the contour of said top side wall; and said primary packages are stacked within said display tray with said branding information facing in a substantially upward direction.

9. The product display of claim 8, wherein:

said bottom side wall of each of said primary packages includes a recess;

said top side wall of each of said primary packages includes a raised section; and said raised section in said top side wall of each of said primary packages is configured to correspond to said recess in said bottom side wall of each of said primary packages such that a raised section in a first primary package is configured for engagement within a recess in a second primary package to inhibit lateral relative shifting of said first and second primary packages when stacked one on top of the other;

said products comprise a plurality of articles of the same shape packaged within each of said primary packages; and said raised section on said top wall of each of said primary packages is shaped to correspond substantially to said article shape.

10. The product display of claim 8, wherein:

a principal display panel with product-specific information is provided on said front side wall of each of said primary packages, said product-specific information being oriented to be read by a consumer when said primary packages are in the substantially horizontal orientation within said display tray;

said product display tray has a front side wall with a consumer-facing surface, a back side wall with a consumer-facing surface, and a bottom wall extending between and supporting said front side wall and said back side wall of said display tray; and said principal display panels of each of said primary packages resting on said bottom wall of said display tray are blocked from being viewed by consumers by said front side wall of said display tray and said branding information formed in said top side wall and facing in a substantially upward direction remains viewable.

11. The product display of claim 8, wherein said branding information is formed by one of debossing, engraving, impressing, and embossing.

12. A product display comprising:

a product display tray having a product display area configured for containing and displaying products therein along a consumer-facing side of said product display tray; and a plurality of primary packages displayed in said product display area;

wherein:

each of said primary packages contains at least one product and is displayed without secondary packaging of the primary packages;

each of said primary packages has:

a front side wall bearing a principal display panel, a back side wall opposite said front side wall, a top side wall extending between said front side wall and said back side wall, and a bottom side wall opposite said top side wall and extending between said front side wall and said back side wall; and a longitudinal axis extending along said front side wall, said back side wall, said top side wall, and said bottom side wall, and along which is formed an opening through which said at least one product within said primary package is accessible;

said product display tray has:

a front side wall with a consumer-facing surface facing said consumer-facing side of said product display tray and bearing product-related indicia;

a back side wall with a consumer-facing surface facing said consumer-facing side of said product display tray and bearing at least some of said product-specific information provided on said principal display panel of each said primary package; and a bottom wall extending between and supporting said front side wall and said back side wall of said display tray;

said bottom side wall of each primary package has at least one stable surface contoured to permit each said primary package to rest in a stable manner thereon in a substantially horizontal orientation with said longitudinal axis oriented substantially horizontally;

said front side wall of each of said primary packages has a principal display panel bearing product-specific information;

said front side wall of said display tray blocks from view at least a portion of a principal display panel of a primary package resting on said bottom wall of said display tray behind said front side wall of said display tray; and a replica of said principal display panel is provided on said consumer-facing surface of said back side wall of said product display tray so that when all primary packages remaining in said display tray have their principal display panels blocked, at least in part, by said front side wall of said display tray, at least some of the information on said principal display panel of each of said primary packages is nonetheless viewable on said consumer-facing surface of said back side wall of said display tray.

13. The product display of claim 12, wherein said replica of said principal display panel is a graphic image of said primary packages in a stacked configuration visually reproducing the image of stacked primary packages.

14. The product display of claim 13, wherein said product-specific information provided on said consumer-facing surface of said back side wall is a 1:1 scaled graphic replica of stacked primary packages.

* * * * *